US005539956A

United States Patent [19]

Wallace

[11] Patent Number: 5,539,956

[45] Date of Patent: Jul. 30, 1996

[54] FINGERED LATCH FOR PALLET-SIZED CONTAINER

[75] Inventor: Mark W. Wallace, Minneapolis, Minn.

[73] Assignee: Temp Top Container Systems, Inc., Edina, Minn.

[21] Appl. No.: 523,368

[22] Filed: Sep. 5, 1995

Related U.S. Application Data

[63] Continuation of Ser. No. 135,880, Oct. 13, 1993.

[51] Int. Cl.[6] ..... E05D 7/10

[52] U.S. Cl. ..... 16/261; 220/4.29

[58] Field of Search ..... 16/231, 260, 261, 16/265, 266, 270; 206/600; 220/4.22, 4.23, 4.34, 4.28, 4.29, 263; 312/265.6, 108, 292

[56] References Cited

U.S. PATENT DOCUMENTS

| | | | |
|---|---|---|---|
| 66,666 | 7/1867 | Rutter . | |
| 133,000 | 11/1872 | Yaw . | |
| 152,520 | 6/1874 | Sanborn . | |
| 886,530 | 5/1908 | Mestemacher . | |
| 1,786,161 | 12/1930 | Jones et al. . | |
| 1,931,397 | 10/1933 | Smith . | |
| 2,210,946 | 8/1940 | Moore . | |
| 2,528,715 | 11/1950 | Wagner . | |
| 3,456,970 | 7/1969 | Sunasky . | |
| 3,678,703 | 7/1972 | Cornish et al. | 62/371 |
| 3,802,220 | 4/1974 | Pompo | 62/530 |
| 3,881,829 | 5/1975 | James | 403/27 |
| 4,244,476 | 1/1981 | Tang | 211/192 |
| 4,406,374 | 9/1983 | Yedor | 211/192 |
| 4,456,142 | 6/1984 | Burling | 220/4 |
| 4,498,312 | 2/1985 | Schlosser | 62/457 |
| 4,561,262 | 12/1985 | Fredrixon | 62/62 |
| 4,591,065 | 5/1986 | Foy | 220/7 |
| 4,618,064 | 10/1986 | Viklund | 211/192 |
| 4,809,851 | 3/1989 | Oestreich, Jr. et al. | 206/599 |
| 4,845,959 | 7/1989 | Magee | 62/457.1 |
| 4,936,615 | 6/1990 | Moore . | |
| 5,070,577 | 12/1991 | Bonneville et al. | 16/260 |
| 5,127,132 | 7/1992 | Karlin | 16/261 |

FOREIGN PATENT DOCUMENTS

| | | | |
|---|---|---|---|
| 406593 | 8/1966 | Switzerland | 16/231 |

OTHER PUBLICATIONS

*Polar Industries Insulated Containers,* Polar Industries catalog.

*Fresh Keeper,* Xactics catalog.

*Primary Examiner*—M. Rachuba

*Assistant Examiner*—Kenneth J. Hansen

*Attorney, Agent, or Firm*—Kinney & Lange, P.A.

[57] ABSTRACT

A hinge system for joining side walls having a first engaged position and a second disengaged position includes a first side wall, a second side wall, a hinge mechanism for joining the first side wall and the second side wall in the first engaged position and a latching mechanism for preventing inadvertently collapse of the first and second side walls. The hinge mechanism has a plurality of barrel lugs having a plurality of barrels and a plurality of hook lugs having a plurality of pins projecting from the hook lugs. Each hook lug is adapted to be positioned between a first adjacent barrel lug and a second adjacent barrel lug so that each pin of each hook lug engages the first adjacent barrel lug. The latching mechanism includes a finger member held in engagement with one of the hook lugs to prevent the pin of each hook lug from disengaging the barrel of the first adjacent barrel lug.

21 Claims, 3 Drawing Sheets

FINGERED LATCH FOR PALLET-SIZED CONTAINER

This is a continuation of application Ser. No. 08/135,880, filed Oct. 13, 1993. Priority of the prior application is claimed pursuant to 35 USC §120.

BACKGROUND OF THE INVENTION

The invention relates to latching mechanisms for containers having side walls which are joined together at their edges by a series of slip pin hinges. In particular, the invention relates to a latching mechanism which unitizes and rigidifies the side walls of the container by preventing disengagement of the slip pin hinges.

The transportation and storage of products and materials often requires that the products or materials be placed in a container or pallet to protect the contents. Containers for shipping the products may be either disposable or reusable. Reusable containers which are not collapsible remain bulky when empty, increasing the expense of returning them to the remote site. As a result, collapsible containers have been employed to reduce storage space and to reduce transportation cost during the return transportation of the containers.

The side walls of these collapsible containers are often joined by a series of slip pin hinges located on the adjacent edges of the side walls. When adjacent side walls are joined together by slip pin hinges, a gap is created between the hook lugs and the barrel lugs of the slip pin hinges. Because the containers experience substantial jarring and vibration during shipment, the hook lugs often disengage the barrel lugs. As a result, the side walls of the container collapse, causing the contents of the container to be damaged.

SUMMARY OF THE INVENTION

The present invention is an improved hinge system for joining side walls of a pallet or pallet-sized container. The hinge system for joining side walls having a first engaged position and a second disengaged position includes a first side wall, a second side wall, a hinge mechanism for joining the first side wall and the second side wall in the first engaged position and a latching mechanism for preventing inadvertent collapse of the first and second side walls. The hinge mechanism has a plurality of barrel lugs having a plurality of barrels and a plurality of hook lugs having a plurality of pins projecting from the hook lugs. Each hook lug is adapted to be positioned between a first adjacent barrel lug and a second adjacent barrel lug so that each pin of each hook lug engages the first adjacent barrel lug. The latching mechanism includes a finger member held in engagement with one of the hook lugs to prevent the pin of each hook lug from disengaging the barrel of the first adjacent barrel lug.

As a result, the finger member holds each pin within each barrel to prevent inadvertent disengagement of the hook lugs from the barrel lugs. Consequently, the latching mechanism protects the contents of the container from being damaged by inadvertent collapse of the side walls.

DETAILED DESCRIPTION OF THE PREFERRED EMBODIMENTS

Figure 1:
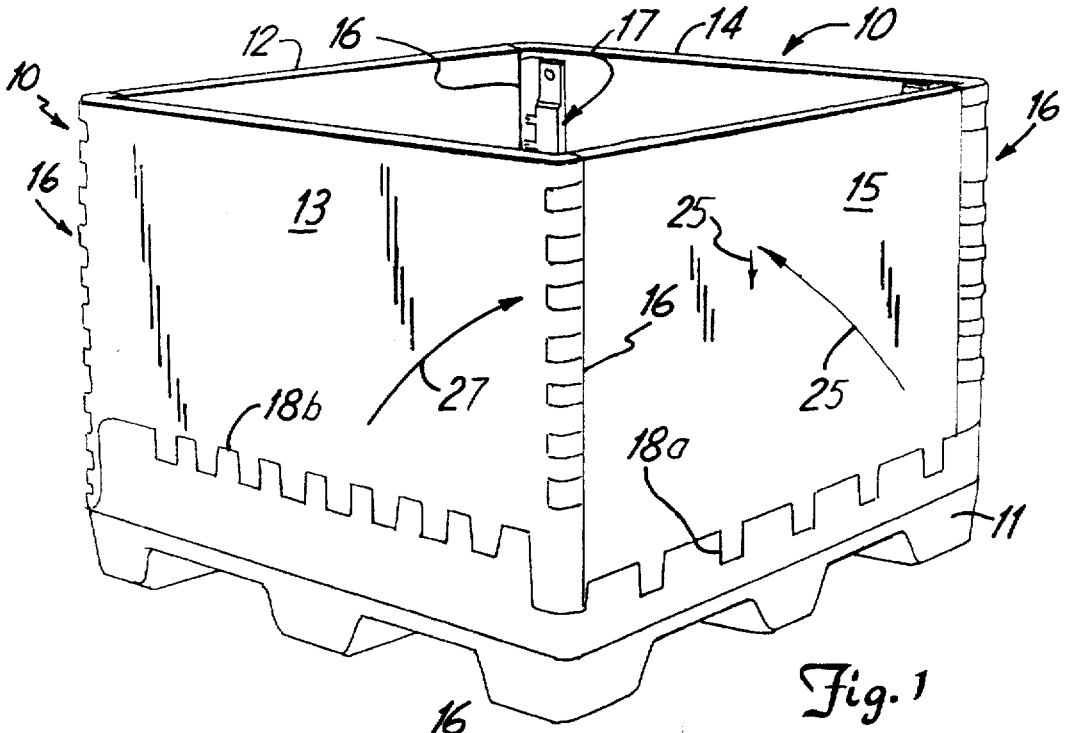
FIG. 1 is a perspective view of a pallet system of the present invention including a latch.

FIG. 1 is a perspective view of pallet system 10. Pallet system 10 includes a base 11, side walls 12–15, hinges 16 and latch 17. Side walls 12–15 extend upward from base 11 and are generally collapsible for ease of storage and transportation when not is use. Side walls 12 and 13 are preferably coupled to base 11 along joints 18*a* so as to permit vertical and radial movement of side walls 12 and 13 as indicated by arrow 25. Side walls 14 and 15 are coupled to base 11 along joints 18*b* so as to permit radial movement of side walls 14 and 15 as indicated by arrow 27. Radial rotation of side walls 12–15 allows side walls 12–15 to be collapsed and folded, or to be unfolded so that side walls 12 and 13 abuts side walls 14 and 15 along hinges 16. Vertical movement of side walls 12 and 13 permits side walls 12 and 13 to be latched into engagement and unlatched out of engagement with side walls 14 and 15 along hinges 16. Side walls 12–15 are adapted to abut one another along adjacent edges to form solid, continuous comers between side walls 12–15.

Latch 17 is rotatably coupled to side wall 14. Latch 17 is mounted to side wall 14 so that latch 17 may be rotated into engagement with hinge 16. Latch 17 prevents the inadvertent disengagement of side walls 12 and 14 along hinge 16. Latch 17 further unifies and rigidities the junction between side walls 12 and 14. As can be appreciated, latch 17 may also be mounted to any one of side walls 12–15 so as to permit latch 17 to engage hinges 16.

Figure 2:
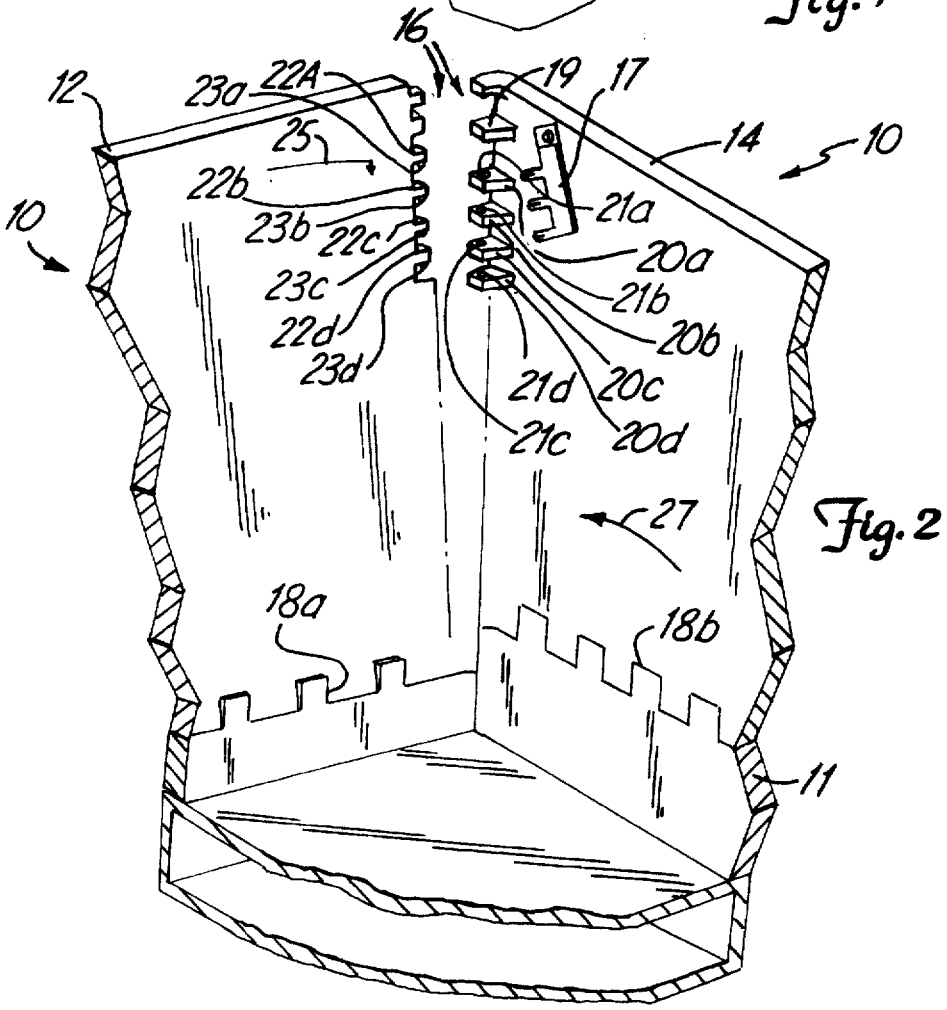
FIG. 2 is a fragmentary perspective view of a corner portion of the pallet system of FIG. 1 in a disengaged position.

FIG. 2 is a fragmentary perspective view of a corner portion of pallet system 10 of FIG. 1. FIG. 2 shows side wall 12 vertically lifted upward and radially rotated outward away from base 11. FIG. 2 shows side wall 14 radially rotated so as to be vertically aligned with base 11. As best shown by FIG. 2, hinge 16 joins side walls 12 and 14 and includes top lug 19, barrel lugs 20*a*, 20*b*, 20*c*, 20*d*, and hook lugs 22*a*, 22*b*, 22*c*, 22*d*. Top lug 19 is an elongated member preferably integrally blow molded with side wall 14 from a polymer such as high density polyethylene. Top lug 19 extends outward from side wall 14 above barrel lug 20*a*. Top lug 19 limits the vertical movement of hook lug 22*a*.

Barrel lugs 20*a*–*d* preferably integrally extend from near an edge of side wall 14. Barrel lugs 20*a*–*d* are preferably spaced apart and in vertical alignment with one another. Barrel lugs 20*a*–*d* are preferably integrally blow molded with side wall 14 from a polymer such as high density polyethylene. Alternatively, barrel lugs 20*a*–*d* can be independently formed and fixedly mounted to side wall 14.

Barrel lugs 20*a*, 20*b*, 20*c*, 20*d* include barrels 21*a*, 21*b*, 21*c*, 21*d*, respectively. Barrel lugs 20*a*, 20*b*, 20*c* are aligned so that barrels 21*a*, 21*b*, 21*c* are in coaxial alignment with one another. Barrels 21 are cylindrical shaped openings extending through an upper surface of barrel lugs 20. Alternatively, barrels 21 may have a variety of shapes and may extend through both an upper surface and a lower surface of each barrel lug 20.

Hook lugs 22*a*–*d* integrally extend and protrude from near an edge of side wall 12. Hook lugs 22*a*–*d* are preferably spaced apart from one another and are in vertical alignment with one another. Hook lugs 22*a–d* are preferably integrally blow molded with side wall 12 from a polymer such as high density polyethylene. Alternatively, hook lugs 22*a–d* can be independently formed and fixedly mounted to side wall 12.

Hook lugs 22*a*, 22*b*, 22*c* include pins 23*a*, 23*b*, 23*c*, respectively. Pins 23*a*, 23*b*, 23*c*, 23*d* comprise downward projecting members sized to fit within barrels 21 of barrel lugs 20. Pins 23 are preferably integrally blow molded with hook lugs 22 from a polymer such as high density polyethylene. Alternatively, pins 23 are independently formed and are mounted to hook lugs 22.

As shown by FIG. 2, side walls 12 and 14 may be radially rotated about joints 18*a* and 18*b* respectively. Barrel lugs 20*a–d* on side wall 14 are alternately positioned with respect to hook lugs 22*a–d* on side wall 12 so that rotation of side walls 12 and 14 to vertical positions, positions each hook lug 22*a–d* between two adjacent barrel lugs 20*a–d* or between top lug 19 and barrel lug 20*a*. For example, hook lug 22*b* will be positioned between barrel lugs 20*a* and 20*b*. In this disengaged position, side walls 12 and 14 abut one another along adjacent edges to form a solid, continuous comer between side walls 12 and 14. At the same time, however, pins 23*a*, 23*b*, 23*c*, 23*d* of hook lugs 22*a–d*, respectively, do not extend into barrels 21*a–d*, respectively. Each pin 23*a–d* is coaxially aligned above a respective barrel 21*a–d*. As a result, side walls 12 and 14 may be rotated about joints 18*a* and 18*b*, respectively, to move side walls 12 and 14 out of abutment and to collapse side walls 12 and 14.

When side walls 12 and 14 are rotated into abutment with one another, side wall 12 may be latched into engagement with side wall 14 by vertically moving side wall 12 downward with respect to side wall 14. This downward vertical movement of side wall 12 with respect to side wall 14 causes pins 23*a–d* to project into and to engage barrels 21*a–d*, respectively. This downward movement also creates a gap between each hook lug 22*a–d* and adjacent top lug 19 or barrel lug 20 positioned above the corresponding hook lug.

Figure 3:
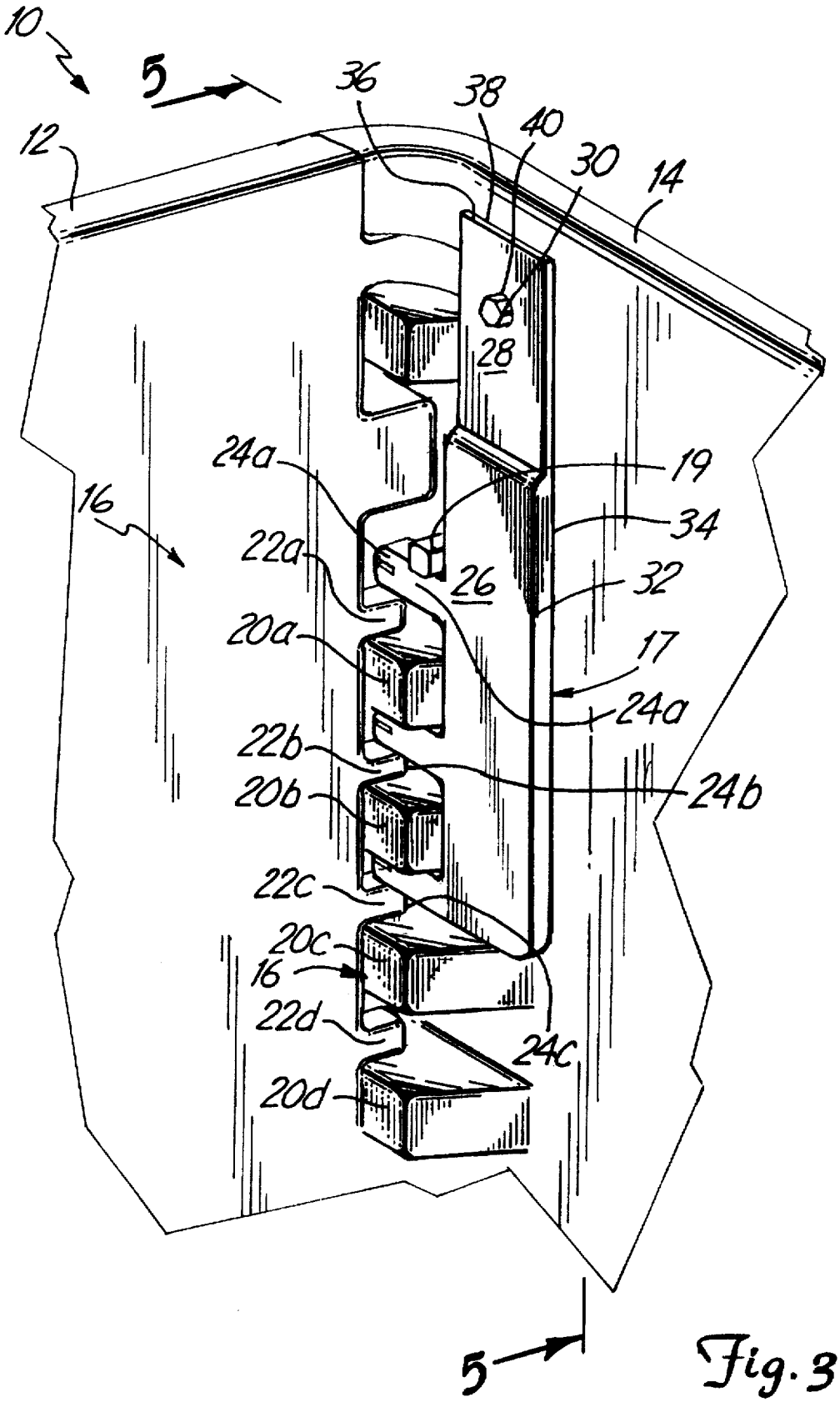
FIG. 3 is a fragmentary perspective view of a corner portion of the pallet system of FIG. 1 in an engaged position.

FIG. 3 shows side walls 12 and 14 rotated into abutment with one another and shows side wall 12 moved vertically downward into engagement with side wall 14. FIG. 3 further shows latch 17 engaging hinge 16. When side walls 12 and 14 are rotated into engagement with one another and side wall 12 is forced downward to latch with side wall 14 along hinge 16, each hook lug 22 engages and mates with its corresponding barrel lug 20. For example, hook lug 22*a* engages and mates with barrel lug 20*a*, while hook lug 22*d* engages and mates with its corresponding barrel lug 20*d*. Hook lugs 22*a–d* engage and mate with barrel lugs 20*a–d* to couple and intermesh side walls 12 and 14. As a result, side walls 12 and 14 may be joined together about hinge 16 to partially define a container or pallet for storing and transporting goods. At the same time, side walls 12 may be forced upward with respect to side wall 14 to disengage hook lugs 22 from barrel lugs 20, permitting side walls 12 and 14 to be separated from one another. Consequently, side walls 12 and 14 may be rotated and collapsed, thereby occupying less space and permitting easier handling.

As best shown by FIG. 3, latch 17 is rotatably coupled to side wall 14 and includes finger members 24*a*, 24*b*, 24*c*, central body 26, mounting portion 28, and screw or bolt 30. Finger members 24 generally comprise elongated, flat, rectangular members sized for insertion between hook lugs 22*a–d* and barrel lugs 20*a–d*. Finger members 24*a–c* project from central body 26 and are spaced apart from one another so that each finger member 24 may be positioned between one of the hook lugs 22*a–d* and an adjacent barrel lug 20*a–d*. For example, finger member 24*c* is positioned between hook lug 22*c* and barrel lug 20*b*, while finger member 24*b* is positioned between hook lug 22*b* and barrel lug 20*a*. Each finger member 24 contacts and engages one of hook lugs 22. As a result, finger members 24*a–c* prevent hook lugs 22 from disengaging barrel lugs 20 so that side wall 12 is not inadvertently dislodged and separated from side wall 14. In addition, because latch 17 includes a plurality of finger members 24*a*, 24*b*, 24*c*, inadvertent dislodgement of latch 17 during shipping and handling is less likely. The plurality of finger members 24*a*, 24*b*, 24*c* further rigidities and strengthens the junction between side walls 12 and 14 formed by hinge 16.

Central body 26 is a flat, rectangular slab. Alternatively, central body 26 may have a variety of lengths and shapes. Central body 26 integrally joins each of the plurality of finger members 24*a*, 24*b*, 24*c*. Thus, to disengage latch 17 requires that each and every finger member 24*a–c* be dislodged from hinge 16. Central body 26 includes a front surface 32 and a rear surface 34. Front surface 32 and rear surface 34 are relatively smooth, flat surfaces. Because the thickness of material between front surface 32 and rear surface 34 is relatively small, latch 17 does not occupy much space. Because front surface 32 and rear surface 34 are flat and smooth, latch 17 is less likely to puncture or damage goods contained within a container or pallet partially defined by side walls 12 and 14.

Mounting portion 28 integrally extends from central body 26 and includes front surface 36, rear surface 38 and mounting hole 40. Front surface 36 of mounting portion 28 is recessed from front surface 32 of central body 26. Rear surface 38 is generally coplanar with rear surface 34 of central body 26. Front surface 36 of mounting portion 28 is recessed to such an extent so that mounting portion 28 may accommodate bolt 30 without bolt 30 protruding beyond front surface 32 of central body 26. Thus, bolt 30 is less likely to puncture or damage goods abutting side wall 14 and latch 17. At the same time, because mounting portion 28 is relatively thin and flat, mounting portion 28 occupies less space and is less likely to interfere with the use of a top or cover positioned above or within side walls 12 and 14.

Bolt 30 extends through mounting hole 40 of mounting portion 28 and rotatably couples latch 17 to side wall 14. As a result, latch 17 is less likely to be lost or misplaced during shipment and handling of a pallet incorporating hinge system 10. Moreover, bolt 30 permits latch 17 to be rotated so that finger members 24*a–c* engage hinge 16 when side walls 12 and 14 are to be coupled together, yet also permits latch 17 to be rotated so that finger members 24 may be disengaged from hinge 16 to permit side wall 12 to move vertically with respect to side wall 14. Consequently, side walls 12 and 14 may be separated from one another and may be collapsed for ease of handling and storage.

In one preferred embodiment, latch 17 has an overall thickness of about 1 inch. Each finger member 24 has a length of about 2¼ inches and a height of about ⅝ of an inch. Central body 26 has a width of about 1¾ inches and a height of about 8⅜ of an inch. Adjacent finger members 24 are preferably spaced apart from one another by about 2 1/16 of an inch. Mounting hole 40 preferably has a diameter of about ¾ of an inch.

Figure 4:
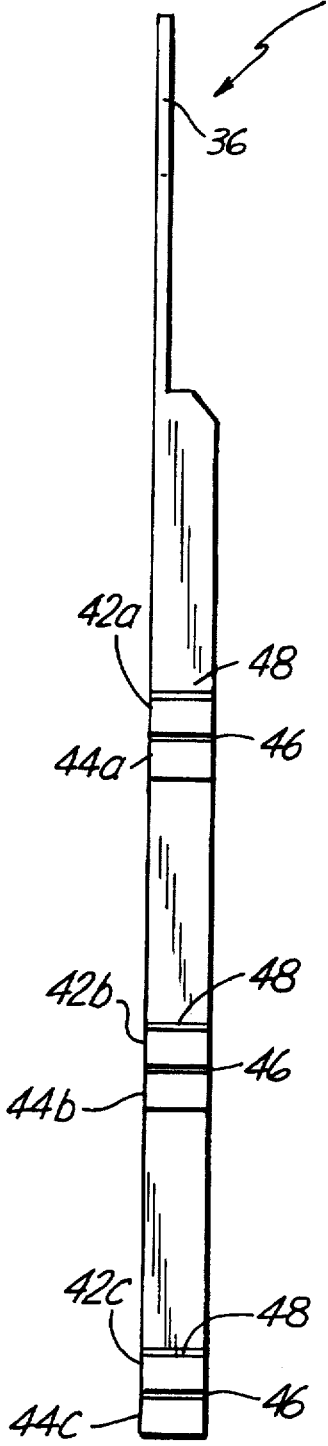
FIG. 4 is a side elevational view of a latch of FIG. 1.
Figure 5:
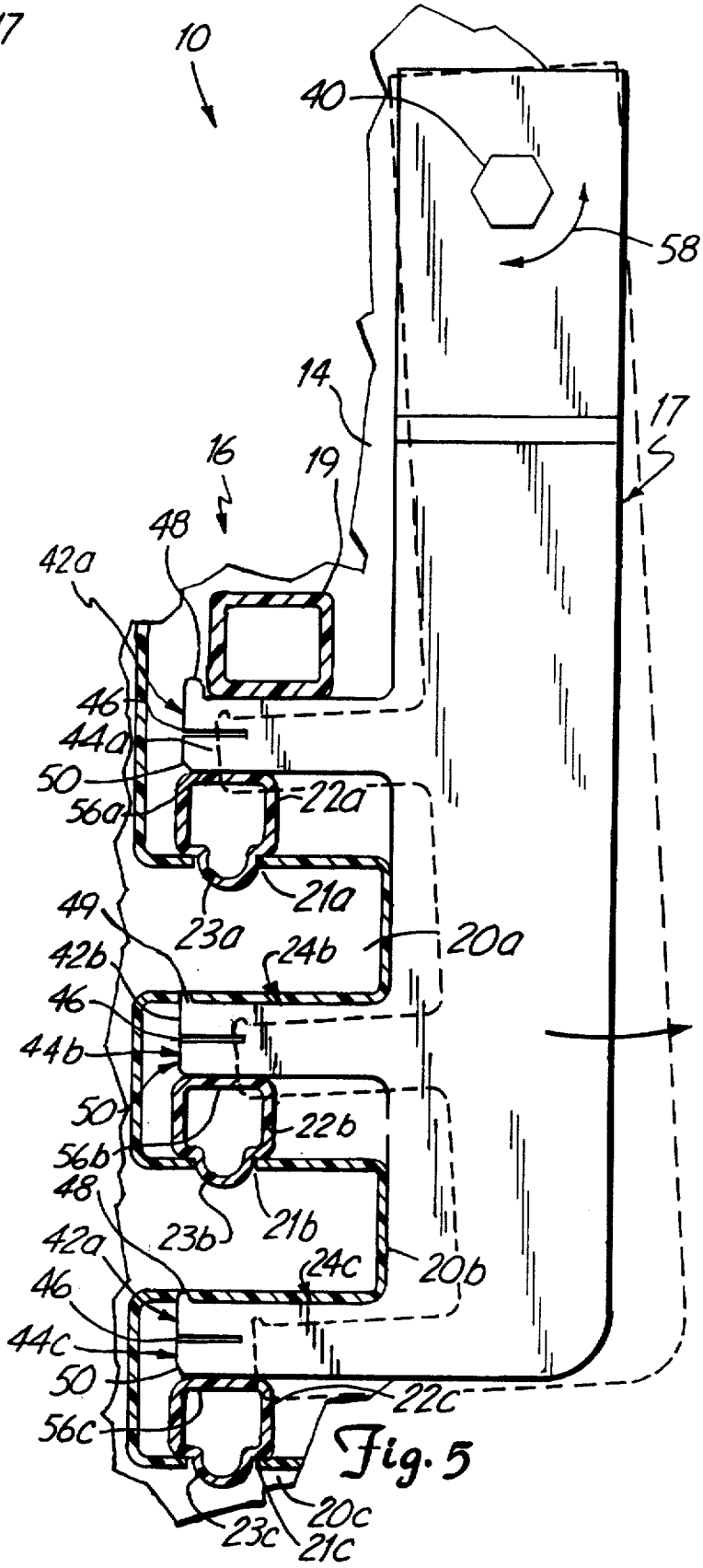
FIG. 5 is a sectional view of the pallet system taken along line 5—5 of FIG. 3.

FIGS. 4 and 5 show latch 17 in greater detail. FIG. 4 shows a side elevational view of latch 17. FIG. 5 is a sectional view of pallet system 10 showing latch 17 engaging hinge 16. As best shown by FIGS. 4 and 5, finger members 24*a*, 24*b*, 24*c* include upper tips 42*a*, 42*b*, 42*c* and lower tips 44*a*, 44*b*, 44*c*.

Upper tip 42 and lower tip 44 of each finger member 24 are separated by a horizontal opening or slit 46. Slit 46 preferably extends into each finger member 24 by about ¼ of an inch. Each slit 46 preferably has a width of about ⅛ of an inch. Slits 46 allow tip portions 42 and 44 to be flexed or pinched so that finger members 24 may be easily inserted between barrel lug 20 and hook lug 22 while establishing a close, tight fit between barrel lug 20 and hook lug 22.

Upper tips 42*a*, 42*b*, 42*c* each include a rib 48. Rib 48 generally comprises a small elongated ridge which integrally projects upward from near the forwardmost edge of upper tip 42. Rib 48 preferably extends along an entire width of upper tip 48. Alternatively, rib 48 may be a relatively short knob or button-like structure. Rib 48 preferably has a height and a width of about ⅛ of an inch. As best shown by FIG. 5, rib 48 engages barrel lug 20 upon insertion of finger member 24 between barrel lug 20 and hook lug 22. Because latch 17 and rib 48 are preferably made from material having a higher density and strength than the polymer used to form barrel lug 20, rib 48 presses into barrel lug 20 to press fit finger member 24 between barrel lug 20 and hook lug 22. Consequently, finger members 24 are less likely to become inadvertently dislodged. At the same time, slit 46 allows each upper tip 42 to be flexed so that rib 48 and finger member 24 may be easily positioned between barrel lug 20 and hook lug 22.

Each lower tip 44 includes a beveled or rounded lower corner 50. Because each corner 50 is rounded or beveled, finger members 24 are more easily insertable between barrel lugs 20 and hook lugs 22 while establishing a tight fit between barrel lugs 20 and hook lugs 22.

When side walls 12 and 14 are rotated so as to engage one another along hinge 16, hook lugs 22*a*, 22*b*, 22*c*, 22*d* are positioned between top lug 19 and adjacent barrel lug 20*a*, barrel lug 20*a* and 20*b*, barrel lugs 20*b* and 20*c*, and barrel lugs 20*c* and 20*d*, respectively. Upon application of a downward force to hook lugs 22*a–d* extending from side wall 12 (not shown), pins 23*a–d* are forced downward into corresponding barrels 21*a–d* to create gaps 56*a*, 56*b*, 56*c* between a top surface of each hook lug 22 and a bottom surface of top lug 19, or adjacent barrel lugs 20*a–c*. For example, gap 56*c* is created between the top surface of hook lug 22*c* and a bottom surface of barrel lug 20*b*. Although pin 23*c* rests within barrel 21*c* and joins side wall 12 to side wall 14, gap 56*c* may cause inadvertent dislodgement of pin 23*c* from barrel 21*c* so as to permit side walls 12 and 14 to separate and to collapse.

As shown by FIG. 5, latch 17 pivots about bolt 40. In a first latched position (shown in bold), finger members 24 of latch 17 are positioned between barrel lugs 20 and hook lugs 22 to fill gaps 56*a–c*. For example, finger member 24*c* is positioned between barrel lug 20*b* and hook lug 22*c* to fill gap 56*c*. Because finger member 24*c* completely fills gap 56*c* to form a tight fit, barrel lug 20*b* holds finger member 24*c* in engagement with hook lug 22*c* to prevent pin 23*c* from becoming inadvertently dislodged from barrel 21*c*. In addition, because latch 17 is rotatably mounted to side wall 14 by bolt 40, vertical movement of latch 17 and finger members 24*a–c* are prevented. Consequently, bolt 40 further holds finger member 24*c* in engagement with hook lug 22*c* so that pin 23*c* remains within barrel 21*c*. Thus, latch 17 eliminates the inadvertent collapse of side walls 12 and 14.

At the same time, latch 17 may be rotated as shown by arrow 58 so that finger members 24*a*, 24*b*, 24*c* are removed from gaps 56*a*, 56*b*, 56*c*, respectively, to allow hook lugs 22 and pins 23, extending from side wall 12 (not shown), to be lifted with respect to side wall 14. Rotation of latch 17 to a second unlatched position (shown by dashed lines) allows pins 23 to be lifted and removed from barrels 21 to permit side walls 12 and 14 to be separated and collapsed for ease of storage and handling.

As can be appreciated, Latch 17 may be used in conjunction with a variety of different hinges. Hinge 16 may have a variety of different shapes. For example, barrels 21 may extend upwardly into each barrel lug while pins 23 may project upwardly from hook lugs 22 so that pins 23 would upwardly extend into barrels 21. With such a hinge, finger members 24 of latch 17 could be positioned between the top surface of each barrel lug and a bottom surface of its corresponding adjacent hook lug. In addition, barrel lugs 20 of side wall 14 and hook lugs 22 of side wall 12 could alternatively be made so as to flex upward and downward permitting pins 23 to be snapped into barrels 21 with the radial rotation of side wall 12.

Although the present invention has been described with reference to preferred embodiments, workers skilled in the art will recognize that changes may be made in form and detail without departing from the spirit and scope of the invention.

What is claimed is:

1. A hinge system for joining side walls having a first engaged position and a second disengaged position, the system comprising:

a first side wall;

a second side wall;

a plurality of adjacent hinge assemblies for joining the first side wall and the second side wall in the first engaged position, the hinge assemblies including:

a barrel lug extending from the first side wall, the barrel lug having a barrel;

a hook lug extending from the second side wall, the hook lug, having a pin projecting from the hook lug, the pin of the hook lug being aligned relative to the barrel of the barrel lug and sized for insertion into the barrel to define a connected hinge assembly to connect the first and second side walls in the engaged position; and a latching mechanism having a latched position for securing the first and second side walls in the first engaged position and an unlatched position for permitting disengagement of the first and second side walls in the second disengaged position, the latching mechanism including:

at least one latching finger sized for insertion into a gap defined between adjacent connected hinge assemblies to restrict axial movement of adjacent hook and barrel lugs; and a support member moveably attached to one of said first or second side walls to move between a latched position and an unlatched position, the latching finger being coupled to the support member and supported thereby in the latched position to extend into the gap between adjacent connected hinge assemblies to restrict axial movement of the hook lugs relative to the barrel lugs and in the unlatched position the latching finger being supported out of alignment with adjacent hinge assemblies to permit disengagement of the pins of the hook lugs out of the barrels of the barrel lugs.

2. The hinge system of claim 1 wherein the support member is pivotally relative to one of said first or second side walls to pivot between the latched position and the unlatched position.

3. The hinge system of claim 2 wherein the support member of the latching mechanism includes a central body, the central body supporting the latching finger and having a first thickness; and a mounting portion pivotally attached to one of said first or second side walls, the mounting portion having a second thickness smaller than the first thickness of the central body.

4. The hinge system of claim 3 wherein the mounting portion includes a hole and including a bolting means sized for insertion through the hole for pivotally mounting the mounting portion to one of said first or second side walls.

5. The hinge system of claim 1 wherein the latching mechanism includes a plurality of adjacent latching fingers sized for insertion into the gap between adjacent connected hinge assemblies, said latching fingers being spaced from adjacent latching fingers for separate insertion into the gaps defined between a series of adjacent connected hinge assemblies.

6. The hinge system of claim 1 wherein the latching finger includes a first flexible tip portion for contacting one of said hook or barrel lug elements of a connected hinge assembly and a second flexible tip portion, said second flexible tip portion being spaced from the first flexible tip portion to define a horizontal slit therebetween for contacting one of said hook or barrel lug elements for allowing the latching finger to be flexed for insertion into the gap between adjacent connected hinge assemblies.

7. The hinge system of claim 1 wherein a leading face of the latching finger includes a protruding rib, said protruding rib being aligned to contact one of said hook or barrel lug elements of a connected hinge assembly to facilitate insertion of the latching finger into the gap between adjacent connected hinge assemblies.

8. The hinge system of claim 1 wherein a leading face of the latching finger includes a rounded edge, said rounded edge being aligned to contact one of said hook or barrel lug elements of a connected hinge assembly to facilitate insertion of the latching finger into the gap between adjacent connected hinge assemblies.

9. The hinge system of claim 1 for detachably connecting a plurality of perpendicularly aligned side walls to form a pallet sized container.

10. A hinging system for connecting and unconnecting a first member and a second member wherein the first and second members are joined in a connected position and separated in an unconnected position comprising:

a plurality of adjacent cooperating hinging elements, the cooperating hinging elements including a barrel lug hinging element having a barrel and a hook lug hinging element having a pin, the hook lug hinging element extending from one of said first or second members and being aligned relative to a cooperating barrel lug hinging element extending from the other of said first or second members to insert the pin of the hook lug hinging element into the barrel of the cooperating barrel lug hinging element for defining connected cooperating hinging elements when the pin of the hook lug hinging element is inserted into the barrel of the barrel lug hinging element; and a latching mechanism comprising:

at least one latching finger sized for insertion into a gap defined between adjacent connected cooperating hinging elements; and a support member movably attached to one of said first or second members to move between a latched position and an unlatched position, the latching finger being coupled to the support member and supported thereby in the latched position to extend into the gap defined between adjacent connected cooperating hinging elements to restrict axial movement of the hook lugs relative to the barrel lugs and in the unlatched position, the latching finger being supported out of alignment with adjacent cooperating hinging elements to permit disengagement of the pins of the hook lug hinging elements out of the barrels of the barrel lug hinging elements.

11. The hinging system of claim 10 wherein the latching mechanism includes a plurality of adjacent latching fingers sized for insertion into the gap between adjacent connected cooperating hinging elements, said latching fingers being spaced from adjacent latching fingers for separate insertion into the gaps defined between a series of adjacent connected cooperating hinging elements.

12. The hinging system of claim 10 wherein the support member is pivotally mounted to pivot between the latched position and the unlatched position.

13. The hinging system of claim 10 wherein said first and second members include a plurality of spaced adjacent hinging elements, adjacent hinging elements of the first member and adjacent hinging elements of the second member being spaced in the unconnected position to provide an insertion gap for inserting the pin of the hook lug hinging element into the barrel of the cooperating barrel lug hinging element, the insertion gap defining a connection gap between adjacent cooperating hinging elements of the first and second members in the connected position and the latching finger being sized for insertion into the connection gap in the connected position.

14. The hinging system of claim 10 wherein the latching finger is similarly sized to the gap defined between adjacent connected cooperating hinging elements.

15. The hinging system of claim 10 wherein the first and second members are aligned to be perpendicularly connected and hinging elements extend parallel from the first member and hinging elements extend perpendicularly from the second member.

16. The hinging system of claim 15 wherein the support member for the latching finger is pivotally mounted to the second member to pivot between the latched position and the unlatched position.

17. The hinging system of claim 10 wherein the support member for the latching finger comprises:

a central body, the central body supporting the latching finger and having a first thickness; and a mounting portion pivotally attached to one of said first or second members, the mounting portion having a second thickness smaller than the first thickness of the central body.

18. The hinging system of claim 10 wherein a leading face of the latching finger includes a rounded edge, said rounded edge being aligned to contact one of said hook or barrel lug hinging elements of a connected cooperating hinging element to facilitate insertion of the latching finger into the gap between adjacent connected cooperating hinging elements.

19. The hinging system of claim 10 wherein a leading portion of the latching finger comprises first and second spaced flexible elements to allow compression of the latching finger, said first flexible element being aligned to contact one of said hook or barrel lug hinging elements of a connected cooperative hinging element and the second flexible element being aligned to contact one of said hook or barrel lug hinging elements of an adjacent connected cooperating hinging element.

20. The hinging system of claim 10 wherein the latching finger includes a protruding rib on a leading face of the latching finger said protruding rib being aligned to contact one of said hook or barrel lug hinging elements of a connected cooperating hinging hinging element to facilitate insertion of the latching finger between adjacent connected cooperating hinging elements.

21. The hinging system of claim 10 wherein the barrel is cylindrically shaped and the pin is cylindrically shaped for insertion therein.

* * * * *

UNITED STATES PATENT AND TRADEMARK OFFICE

CERTIFICATE OF CORRECTION

PATENT NO. 5,539,956

DATED JULY 30, 1996

INVENTOR(S) MARK W. WALLACE

It is certified that error appears in the above-indentified patent and that said Letters Patent is hereby corrected as shown below:

Col. 2, line 27, delete "comers", insert --corners--

Col. 2, line 31, delete "rigidities", insert --rigidifies--

Col. 3, line 22, delete "comer", insert --corner--

Col. 4, line 11, delete "rigidities", insert --rigidifies--

Col. 5, line 28, delete "comer", insert --corner--

Signed and Sealed this

Tenth Day of December, 1996

*Attest:*

*Attesting Officer*

Bruce Lehman

BRUCE LEHMAN

*Commissioner of Patents and Trademarks*